US007621322B2

(12) United States Patent
Arnold et al.

(10) Patent No.: US 7,621,322 B2
(45) Date of Patent: Nov. 24, 2009

(54) THRU-TUBING HIGH EXPANSION INFLATABLE SEAL WITH MECHANICAL ANCHORING SYSTEM AND METHOD

(75) Inventors: George S. Arnold, Houston, TX (US); Gordon R. Mackenzie, Cypress, TX (US); Graeme Michael Kelbie, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 136 days.

(21) Appl. No.: 11/599,248

(22) Filed: Nov. 14, 2006

(65) Prior Publication Data

US 2007/0107913 A1 May 17, 2007

Related U.S. Application Data

(60) Provisional application No. 60/737,642, filed on Nov. 16, 2005.

(51) Int. Cl.
*E21B 33/12* (2006.01)

(52) U.S. Cl. ..... 166/187; 166/387

(58) Field of Classification Search ..... 166/187, 166/206, 373, 386, 120, 122, 387
See application file for complete search history.

(56) References Cited

U.S. PATENT DOCUMENTS

| | | | | |
|---|---|---|---|---|
| 3,872,925 | A * | 3/1975 | Owen et al. | 166/286 |
| 4,869,324 | A * | 9/1989 | Holder | 166/387 |
| 5,297,633 | A | 3/1994 | Snider et al. | 166/387 |
| 5,988,287 | A | 11/1999 | Jordan, Jr. et al. | 166/386 |
| 6,213,217 | B1 * | 4/2001 | Wilson et al. | 166/387 |
| 6,318,461 | B1 * | 11/2001 | Carisella | 166/196 |
| 6,834,725 | B2 | 12/2004 | Whanger et al. | 166/384 |
| 7,104,323 | B2 * | 9/2006 | Cook et al. | 166/278 |
| 7,178,602 | B2 * | 2/2007 | Hiorth et al. | 166/382 |
| 2003/0221830 | A1 * | 12/2003 | Leising et al. | 166/278 |

OTHER PUBLICATIONS

Machado, Fernando A., et al. "Case History of a Successful Selective Horizontal Openhole Gravel Pack with Zonal Isolation in Deep Water Field," OTC 15128, Houston, Texas, May 5-8, 2003.

Murphy, David Patrick. "What's New in MWD and Formation Evaluation," World Oil Magazine, vol. 219, No. 3, Mar. 1998. 5 pages.

Eaton, M. L., et al. "New Workover and Completion Technology Utilised in Bass Strait," SPE 64400, Brisbane Australia, Oct. 16-18, 2000.

Afghoul, A.C., et al. "Coiled Tubing: The Next Generation," Oilfield Review, pp. 38-57, Spring 2004, 20 pages.

* cited by examiner

*Primary Examiner*—Jennifer H Gay
*Assistant Examiner*—Yong-Suk Ro
(74) *Attorney, Agent, or Firm*—Cantor Colburn LLP

(57) ABSTRACT

A downhole tool includes a thru-tubing high expansion, elastomeric inflatable seal and a thru-tubing mechanical anchoring arrangement. A method for separating pressure in a wellbore including actuating a mechanical anchoring system of a thru-tubing downhole tool; inflating a high expansion inflatable elastomeric seal against the tubing subsequent to actuating said mechanical anchor.

10 Claims, 6 Drawing Sheets

THRU-TUBING HIGH EXPANSION INFLATABLE SEAL WITH MECHANICAL ANCHORING SYSTEM AND METHOD

CROSS REFERENCE TO RELATED APPLICATIONS

This application claims the benefit of an earlier filing date from U.S. Provisional Application Ser. No. 60/737,642 filed Nov. 16, 2005, the entire disclosure of which is incorporated herein by reference.

BACKGROUND

Thru-tubing devices intended to provide pressure-sealing capabilities generally comprise high expansion elastomeric tubulars, which perform a dual function of pressure separation and mechanical anchoring. While such systems do perform adequately for their intended purpose, it should be pointed out that the function of mechanical anchoring tends to reduce some of the functionality related to pressure separation. Over a period of time, such reduction in functionality can become detrimental to optimization of well performance. This is generally because over the lifetime of a particular well, parameters including pressure and temperature will change. Changing parameters requires adaptability with respect to the elastomeric sealing elements. If, as in the prior art, some of the sealing functionality has been displaced by use of the sealing element for mechanical anchoring, the pressure separation tool may not possess sufficient adaptability to function optimally as pressure and temperature (or other parameters) change.

SUMMARY

Disclosed herein is a downhole tool that includes a thru-tubing high expansion, elastomeric inflatable seal and a thru-tubing mechanical anchoring system.

Further disclosed herein is a method for separating pressure in a wellbore including actuating a mechanical anchoring system of a thru-tubing downhole tool; inflating a high expansion inflatable elastomeric seal against the tubing subsequent to actuating said mechanical anchor.

BRIEF DESCRIPTION OF THE DRAWINGS

Referring now to the drawings wherein like elements are numbered alike in the several Figures.

Figure 1A:
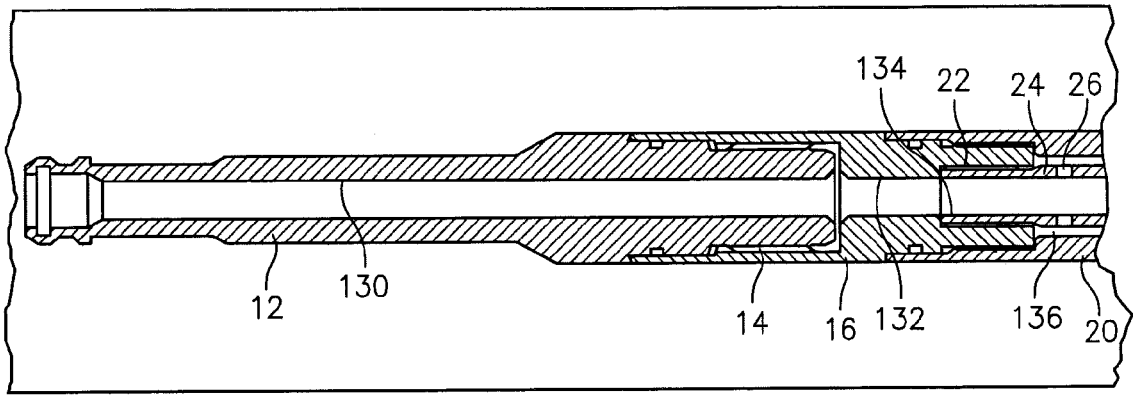
FIGS. 1A through 1E is an elongated illustration of one embodiment of a high expansion thru-tubing pressure separator and mechanical anchor as detailed herein. This string of figures illustrates the device in the running position.
Figure 2A:
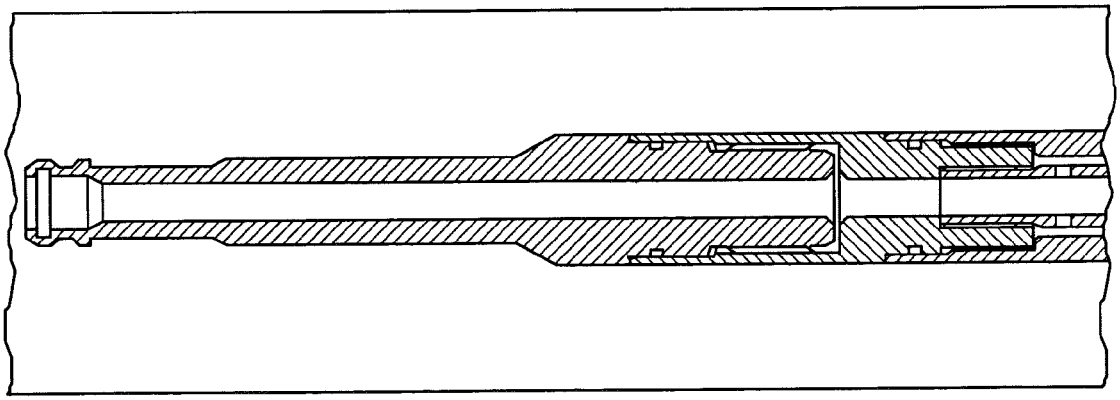
FIGS. 2A through 2E is the same device as that shown in FIG. 1 but in a deployed position within a tubing string.
Figure 1B:
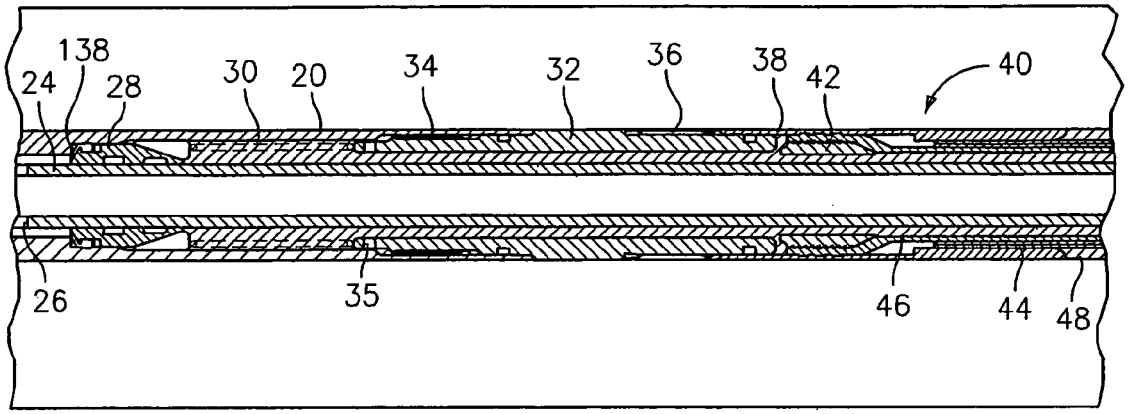
Figure 2B:
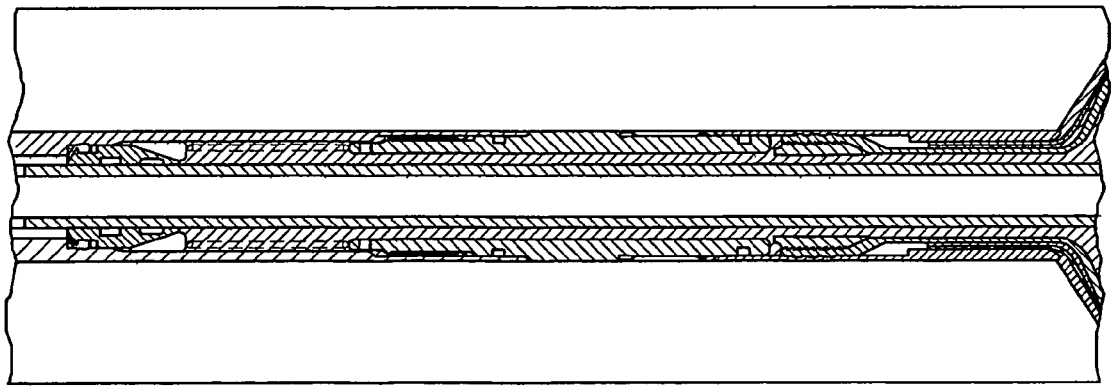
Figure 1C:
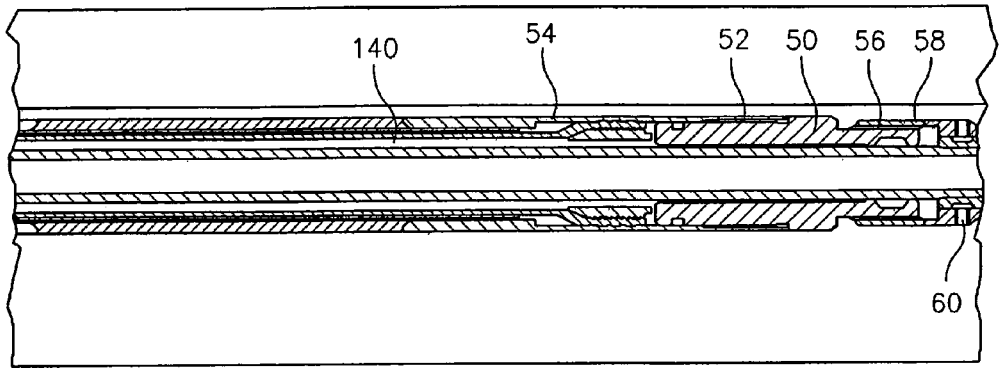
Figure 1D:
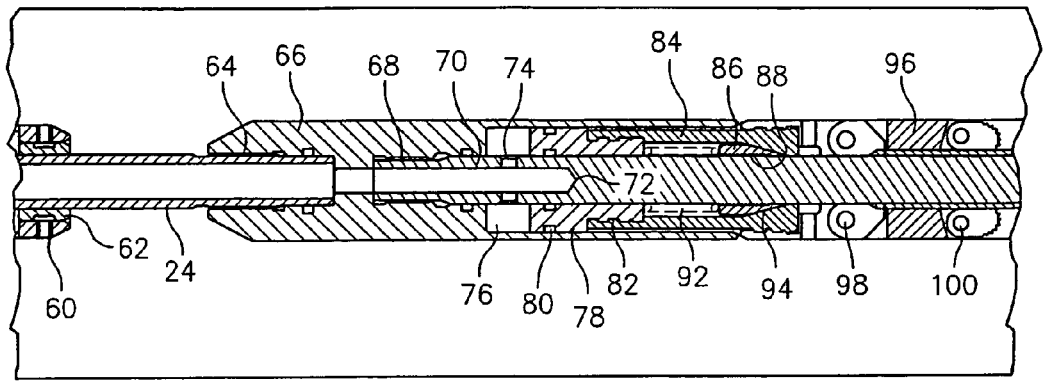
Figure 2D:
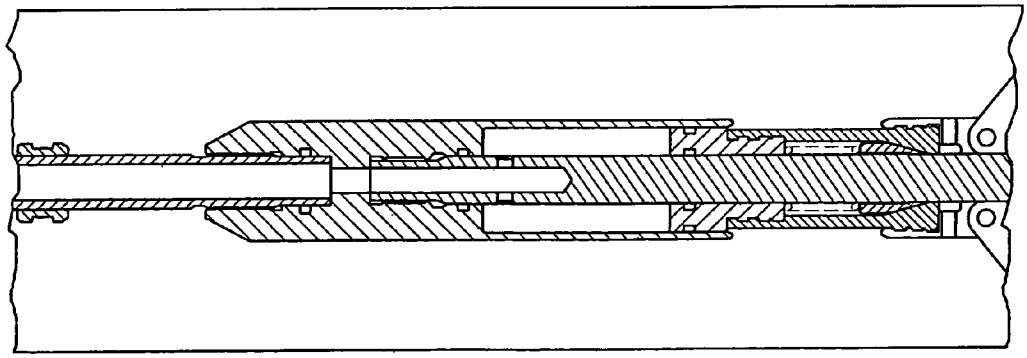

It is to be pointed out generally with respect to FIG. 1A through a portion of FIG. 1D that the illustrated components comprise a commercially available thru-tubing inflatable bridge plug available from Baker Oil Tools, Houston, Tex., under exemplary part number H340012101 (similar numbers are utilized for different sizes within the 2.125 to 5.750 diameter range). The commercially available device, however, includes a blanking plug at what would be a downhole end of the tool. Clearly the blanking plug is not shown as it is not a part of this invention and rather a mechanical anchoring arrangement is attached to the bridge plug in its place.

To enhance understanding of the device, each of the components will be identified and labeled for the entirety of the tool. At the uphole end of the tool, referring to FIG. 1A, illustrated is a fishneck 12. A fishneck 12 is threadedly attached at thread 14 to a top sub 16 which is itself threadedly attached at a pin thread to a check valve housing 20 and at a box thread 22 to a mandrel 24. It is noted at this point that mandrel 24 further includes a plurality or ports 26 for pressure transmission for actuation of the tool.

Moving to FIG. 1B, radially outwardly at mandrel 24 and housed within check valve housing 20 is check valve 28. The check valve 28 is biased to a closed position by coil spring 30, which is bounded at its downhole end by an uphole end of a connector sub 32. Check valve housing 20 is threadedly connected at thread 34 to connector sub 32 and an uphole end of connector sub 32 are a plurality of shear-member holes 35 which may optionally be used to secure the check valve 28 until a preselected pressure differential is experienced. Connector sub 32 is threadedly joined at thread 36 to end sleeve 38 of inflatable elastomeric seal 40. Elastomeric or inflatable seal 40 further comprises a tube retainer 42, which holds the rubber tube in place so that it does not pull away during inflation thereof. Further, inflatable 40 includes ribs 44 to reduce extrusion of an inner cover 46. An outer cover 48 is provided for contact with the tubing string inner wall. One of ordinary skill in the art will appreciate that the uphole end and the downhole end of inflatable 40 are mirror images of one another and need not be labeled twice.

Moving to FIG. 1C, at a downhole end of the inflatable 40 is a bottom adaptor 50 that is threadedly connected at 52 to a downhole end sleeve 54. The bottom adaptor is threaded at thread 56 to a shear adaptor 58, which contains a plurality of apertures 60 to receive shear members (or other similarly acting packer inflation release members).

Moving to FIG. 1D, shear members (not shown) extend through openings 60 to engage the shear adaptor ring 62, which is fixedly attached at its inside dimension to mandrel 24.

It was noted above that the commercially available thru-tubing inflatable bridge plug contains a blanking plug, which is not shown in these drawings. The blanking plug would be located and threadedly connected at thread 64 of the mandrel 24. In this embodiment of the invention, however, a piston housing 66 is threadedly connected at thread 64 to mandrel 24. Piston housing 66 provides a box stub connection 68 to an anchor mandrel 70, which includes both a dead end 72 and a pressure outlet 74, generally provided as a plurality of openings. Opening(s) 74 provide pressure access from the inside dimension of mandrel 70 to a chamber 76, which bears upon an uphole end of a piston 78. One of skill in the art will recognize a common drafting practice of providing small square-like notches in components of the tool to indicate a seal such as an o-ring. This is indicated at 80 in FIG. 1D and should be understood to include all of such square indicators throughout the tool. In each one of such indicators a seal such as an o-ring is provided. Piston 78 is threadedly connected at thread 82 to a bowl 84 extending downhole therefrom. Located within the inside of the bowl 84 is a slip structure 86 having biting teeth 88 on an inside dimension thereof to bite into and hold to an anchor mandrel 70. A spring 92 abuts a downhole end of piston 78 and urges slips 86 in the downhole direction and along inclined surface 94 of bowl 84 to engage teeth 88 of slips 86 with the mandrel 70. The spring 92 ensures that there is no lost motion of the slips 86 when pressure is relieved from chamber 76 due to discontinuation of application of pressure from the remote location, which may be the surface. This arrangement further ensures that final anchor actuation is independent of element pressure.

Figure 2C:
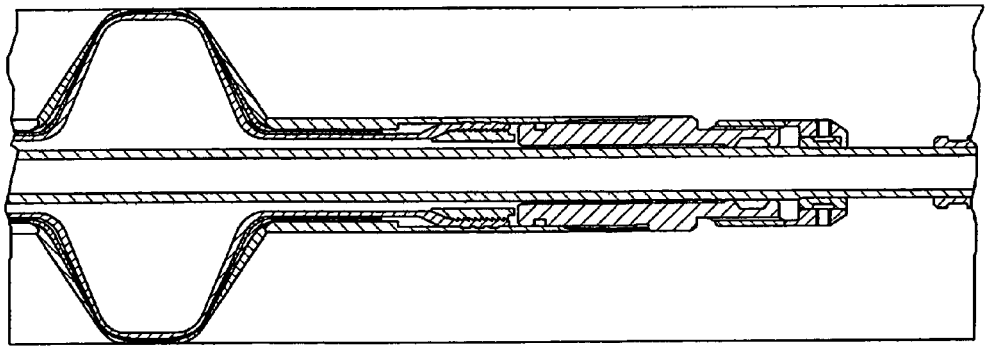
Figure 1E:
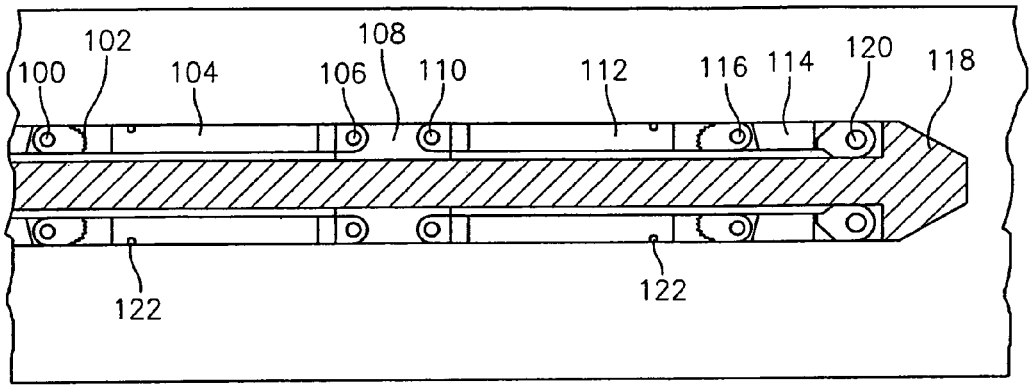
Figure 2E:
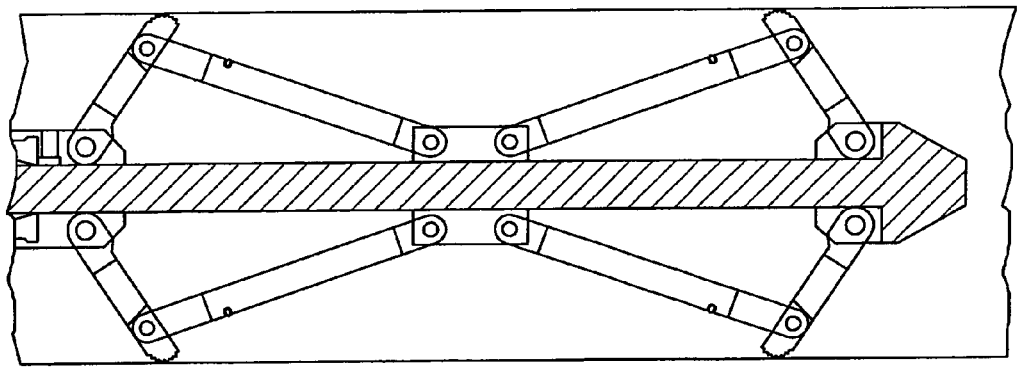

Upon the movement of piston 78 in the downhole direction, slip links 96 which are articulated at an uphole end at pin 98 and at the downhole end at pin 100 begin to move toward a set position wherein the set of teeth 102 illustrated in FIG. 1E move outwardly from the anchor mandrel 70 towards an inside dimension of a tubing string in which the tool is to be set. As slip links 96 move in that direction, a long link 104, which is also articulated at pivot 100 with slip link 96, moves radially outwardly with slip link 96. Since long link 104 is also articulated at pivot point 106 on pivot frame 108, the frame 108 is urged in a downhole direction thereby forcing pivot 110 downhole and causing a downhole long link 112 to move outwardly along with a downhole slip link 114 at pivot 116. The downhole slip link 114 is also pivotably connected to a guide 118 at pivot point 120. The mechanical anchor is assisted in remaining in the run-in position by a set of springs 122 in locations calculated to maintain the position thereof. A view of FIG. 2E will make the functionality and mode of operation of this section of the tool (described with respect to FIG. 1E) quite apparent to one of ordinary skill in the art.

In operation, in one embodiment of the invention, fluid pressure is applied to the device from a remote location uphole of the fishneck 12 illustrated in FIG. 1A. This pressure is communicated through an inside dimension 130 of fishneck 12 through to an inside dimension 132 of top sub 16 and into the inside dimension 134 of mandrel 24. Fluid pressure is therefore communicated all the way down mandrel 24 until it dead ends at numeral 72 illustrated in FIG. 1D. Fluid pressure at a first level is then communicated through ports 74 into chamber 76 whereby piston 78 can be pushed downhole causing the sequence of events related to actuation of the anchor as discussed hereinabove. This will cause the mechanical anchoring system to anchor against the inside dimension of a tubing string in which it is intended to be deployed. Further increased pressure will find ports 26 (though it is to be understood that the first pressure level also acted on these ports) illustrated in FIG. 1A. The ports lead to a chamber 136 in operable communication with check valve 28. Pressure within chamber 136 caused by increased pressure within the mandrel 24 will unseat check valve 28 from its valve seat 138 (check valve 28 does not unseat when exposed to the first pressure level). It is to be recognized, and should be familiar to one of ordinary skill in the art, since the device is a commercially available part, that although not easily seen in the drawings, the check valve 28 is a fluted part. Therefore, once the seat 138 and check valve 28 are parted based upon fluid pressure in chamber 136, the hydraulic fluid or whatever other fluid is contained within mandrel 24, is free to flow easily past check valve 28. This fluid flows within fluid path 140 (numbered on FIG. 1C but extends also onto FIG. 1B), which pathway is exposed at an outside diameter thereof to the inner bladder 46. Increasing pressure causes inner bladder 46 to yield along with ribs 44 and outer cover 48 in a radially outward direction into the condition illustrated in FIG. 2C. One will also recognize that the packer inflation release member, or as illustrated shear screws 60, have sheared from shear ring 62 allowing bottom adapter 50 to move uphole relative to mandrel 24, thus accommodating the circuitous path now required of inflatable element 40. At this point the tool is set both from the mechanical anchoring standpoint and the pressure separation standpoint as the mechanical anchor is anchored to the tubing string and the inflatable element is pressuredly engaged with the tubing string wall.

Figure 3:
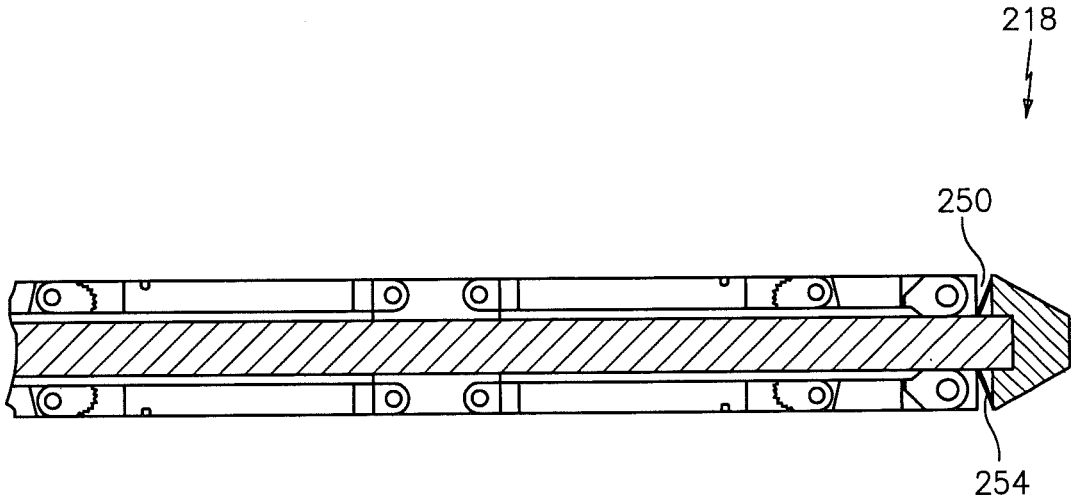
FIG. 3 is an alternate guide for greater reliability of this device.

Referring to FIG. 3, another embodiment of the above-disclosed structure includes a guide 218 that is moderately different from guide 118 in that a gap 250 is provided to accept a spring-like energizing device 254 such as a spring washer or wave washer. The energetic device helps to energize the links into contact with the tubing.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. A downhole tool comprising:

a thru-tubing high expansion, elastomeric inflatable seal settable at a seal set pressure;

a thru-tubing mechanical anchoring arrangement operably connected to the seal being settable at an anchor set pressure, the seal set pressure being greater than the anchor set pressure; and a valve in operable communication with the elastomeric inflatable seal and the thru-tubing mechanical anchoring arrangement being openable at a pressure between the anchor set pressure and the seal set pressure.

2. The tool as claimed in claim 1, wherein the mechanical anchoring arrangement includes articulated slip links.

3. The tool as claimed in claim 1, wherein the tool includes a release member.

4. The tool as claimed in claim 3, wherein the release member delays inflation of the seal until subsequent to actuation of the anchor.

5. The tool as claimed in claim 1, wherein the tool is retrievable.

6. The tool as claimed in claim 1, wherein the valve prevents fluid flow to the elastomeric inflatable seal until after the thru-tubing mechanical anchoring arrangement has been actuated.

7. A method for separating pressure in a wellbore comprising:

actuating with a first pressure a mechanical anchoring system of a thru-tubing downhole tool embodying said anchoring system and a high expansion inflatable elastomeric seal;

opening a valve in response to achieving a threshold pressure that is greater than the first pressure wherein the threshold pressure is less than a second pressure; and inflating the high expansion inflatable elastomeric seal against the tubing with the second pressure that is greater than the first pressure subsequent to actuating and securing said mechanical anchor.

8. The method as claimed in claims 7 wherein the actuating includes applying fluid pressure from a remote location.

9. The method as claimed in claims 7 wherein the actuating causes both a mechanical engagement of the tool with an inside dimension of a tubing and an engagement internal to the tool to secure it in place.

10. The method as claimed in claims 7 wherein the inflating requires releasing of a release member prior to the tool allowing fluid pressure to inflate the high expansion inflatable elastomeric seal.

* * * * *